United States Patent [19]

Inagaki et al.

[11] 4,022,997

[45] May 10, 1977

[54] COLLISION DETECTING APPARATUS FOR MOTOR VEHICLES

[75] Inventors: Mitsuo Inagaki, Okazaki; Hideaki Sasaya; Akihiro Kobayashi, both of Aichi, all of Japan

[73] Assignee: Nippon Soken, Inc., Nishio, Japan

[22] Filed: Nov. 25, 1975

[21] Appl. No.: 635,073

[30] Foreign Application Priority Data

| | | |
|---|---|---|
| Nov. 27, 1974 | Japan | 49-145021[U] |
| Aug. 1, 1975 | Japan | 50-94463 |
| Aug. 5, 1975 | Japan | 50-95505 |
| Aug. 9, 1975 | Japan | 50-110071[U] |

[52] U.S. Cl. ..... 200/61.45 R; 200/61.48

[51] Int. Cl.[2] ..... H01H 35/14

[58] Field of Search ... 200/52 A, 61.45 R, 61.45 M, 200/61.46, 61.48, 61.49, 61.5, 61.51, 61.52

[56] References Cited

UNITED STATES PATENTS

| | | | |
|---|---|---|---|
| 2,710,578 | 6/1955 | Rabinow | 200/61.45 R X |
| 2,920,157 | 1/1960 | Rabinow et al. | 260/61.48 |
| 3,012,157 | 12/1961 | Baring et al. | 20/61.46 X |
| 3,246,092 | 4/1966 | Todd | 200/61.45 R |

*Primary Examiner*—James R. Scott

*Attorney, Agent, or Firm*—Cushman, Darby & Cushman

[57] ABSTRACT

Apparatus for detecting collision of a motor vehicle, carried by the vehicle and adapted to produce an electrical signal upon the collision of the vehicle to actuate occupant protection systems. The collision detecting apparatus comprises a rotational member in which the center of gravity is shifted from it's rotational axis so that collision energy applied thereto upon the collision of vehicle is converted into rotational energy of the rotational member, to actuate a contact device for producing the electrical signal. The apparatus is characterized by a simplified and small-sized structure, reliable in operation and generation of the collision signal.

11 Claims, 15 Drawing Figures

COLLISION DETECTING APPARATUS FOR MOTOR VEHICLES

BACKGROUND OF THE INVENTION

The present invention relates to a collision detecting apparatus for a vehicle which operates in response to deceleration of the vehicle upon the collision thereof and generates a collision signal to actuate a driver or passenger protecting apparatus such as air-bag or the like.

There have been hithertofore proposed various collision detecting apparatus which are interposed between a power supply source and the driver or passenger protection apparatus, and used to produce a collision signal upon the collision of the vehicle so as to establish current path from the power supply source to the protection apparatus to be actuated. However, the conventional collision detecting apparatus have been too large in size to be conveniently installed in a compartment or a bumper of the vehicle. Further, the prior known apparatus has required a rather complicated structure and nevertheless is impractical in that the apparatus is incapable of generating a stabilized signal of as long a duration as to actuate the protection apparatus.

For example, collision detecting apparatus utilizing the principle that the collision is sensed as a linear movement of a system of particles has been well-known . The apparatus comprises therefore a weight adapted to move linearly in the moving direction of the vehicle upon the collision thereof, a spring for providing resistance to the linear movement of the weight, a contact system actuated by the movement of the weight and a casing for accommodating these elements.

The collision detector apparatus of the above type is not suitable for mounting a leading portion of the vehicle, such as a bumper, for following reasons. Namely, the deceleration at the leading portion of the vehicle when the collision of the vehicle may be so great that the displacement of the weight subjected directly to the deceleration should be set at a large value. Accordingly, the overall size of the collision detecting apparatus becomes too bulky to be mounted in the small space available at the vehicle.

However, when the displacement of the weight would be small, the resistance applied to the weight or the force of the spring may be increased. However, this gives rise to an increase in the natural vibration frequency or characteristic frequency of the vibration system including the spring and the weight. When the charateristic frequency is increased, the actuation level at which the collision signal is generated will be varied remarkably with the deceleration applied to the vibration system, in various manners, for example, a front-collision or an oblique collision. Thus, it results in the collision detecting apparatus having no stabilized actuation level.

SUMMARY OF THE INVENTION

An object of the present invention is to eliminate the disadvantages of the hitherto known collision detecting apparatus described above.

According to the present invention, there is provided a collision detecting apparatus for a motor vehicle which comprises a rotational member having a weight secured thereto for converting the collision energy generated by the deceleration upon the collision into a rotational energy, which is then utilized for actuating a contact device to generate a collision detecting signal. The apparatus according to the present invention can generate the stabilized collision detecting signal in a reliable operation with a simplified structure which eliminates erroneous operation.

BRIEF DESCRIPTION OF THE DRAWINGS

The above and other objects, novel features and advantages of the invention will become more apparent by reference to the following description of preferred embodiments of the invention with reference to the accompanying drawings, in which.

DETAILED DESCRIPTION OF PREFERRED EMBODIMENT

Now, the invention will be described with reference to the drawings which illustrate preferred embodiments of the invention.

Figure 1:
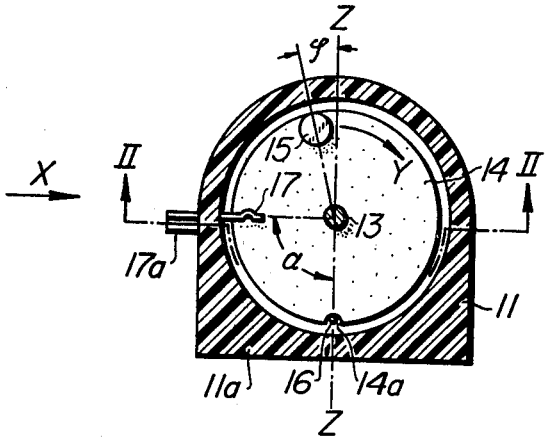
FIG. 1 is a cross-sectional view of a first embodiment of the collision detecting apparatus according to the invention.
Figure 2:
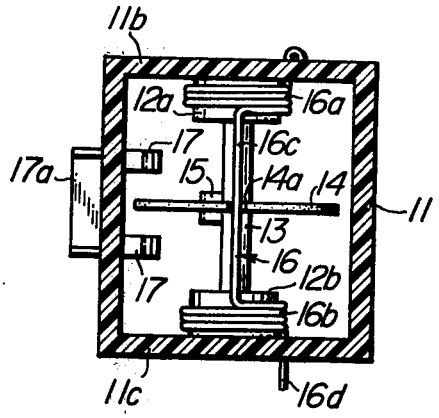
FIG. 2 shows a section of the same taken along the line II — II in FIG. 1.

Referring to FIGS. 1 and 2, reference numeral 11 designates a box-like casing which is made of an electrically insulating synthetic material having a sufficient mechanical strength such as those commercially available under the trade names "Derlin", "Duracon" or the like, for example. The casing 11 is composed of a bottom portion 11*a* and side wall portions 11*b*, 11*c* extending upwardly from the bottom portion 11*a*. Secured to the side wall portions 11*a* and 11*c* in opposition to each other by means of a bonding material are bearings 12*a* and 12*b* which are made of aluminium, brass or the like material.

Reference numeral 13 denotes a steel shaft which is supported rotatably by means of the bearings 12*a* and 12*b* substantially in a horizontal position. and has a disk 14 so secured thereto at the center of the disk, that the disk 14 is perpendicular to the shaft 13 extending therethrough. The disk 14 is made of an electrically insulating resin material such as Bakelite, Derlin or the like. The disk 14 is formed with a notch 14*a* at the periphery thereof. Further, a column-like weight 15 made of aluminium, iron or the like is secured to the peripheral portion of the disk 14, extending through the latter. In this manner, the disk 14 is so secured to the shaft 13 as to obtain a dynamic unbalance due to the shift of the center of gravity of the disk 14 from the longitudinal rotation axis of the shaft 13, so that the disk 14 is likely to be rotated under the action of the weight 15 upon being subjected to deceleration.

Numeral 16 designates an electrically conductive torsion soil spring having spirally coiled end portions 16*a* and 16*b* and an intermediate straight portion 16*c* extending between the end portions 16*a* and 16*b*, these portions 16*a*, 16*b* and 16*c* being integrally connected to form the torsion coil spring 16. The spiral end portions 16*a* and 16*b* of the torsion coil spring 16 are respectively disposed around the outer peripheries of the bearings 12*a* and 12*b* and engaged with the side wall portions 11*b* and 11*c* of the casing 11 in such an arrangement that the straight portion 16*c* of the torsion coil spring 16 is positioned immediately below the shaft 13. It is noted that the free end of the spiral portion 16*b* extends through the side wall portion 11*c* and is formed with a terminal 16*d*.

As will be seen from FIG. 2, the straight portion 16*c* of the torsion coil spring 16 is caught through the notch 14*a* formed in the disk 14 so as to provide resistance or inital load to the rotation of the disk 14 in the direction indicated by arrow Y. In this manner, the disk 14 is prevented from being rotated in response to acceleration or deceleration smaller than a predetermined value.

Due to the engagement between the notch 14*a* of the disk 14 and the straight portion 16*c* of the torsion coil spring 16, the disk 14 normally reamins stationary. In this connection, it is to be noted that the stationary position of the weight 15 is so set that it may form an angle $\phi$ with the vertical line Z — Z extending through the center axis of the shaft 13. The angle $\phi$ should preferably be in the range of 5° to 30° and is set to the most desirable value of 10° in the illustrated embodiment.

Figure 3:
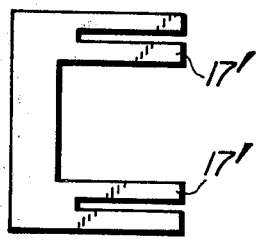
FIG. 3 is a plan view of a modification of the leaf spring used in the apparatus shown in FIG. 2.

Reference numeral 17 indicates a stationary contact disposed in the casing 11 at a position to form an angle $\alpha$ with straight line Z—transversing through the axis of the straight portion 16*c* and the axis of the disk 14. The stationary contact 17 consists of an electrically conductive leaf spring having free end portion of semicircularly curved contour (FIG. 1) so that the leaf spring contacts 17 may reliably receive the straight portion 16*c* of the torsion coil spring 16. In the case of the illustrated embodiment, a pair of the leaf spring contacts 17 are provided in a juxtaposition at the both sides of the disk 14. It will be noted that the leaf spring contacts 17 extend outwardly through the casing 11 and form a terminal 17*a* at the outside thereof. Due to the arrangement of the paired leaf spring contacts 17 each being disposed at the side positions symmetrial to the rotation plane of the disk 14, any possible failure in the contact with the straight portion 16*c* of the torsion coil spring 16 can be eliminated. If desired, the number of the contact area portions may be increased by providing bifarcated fingers at the free end portion of the leaf spring contacts 17 as is shown in FIG. 3, thereby to prevent the possible phenomenon of chuttering. It goes without saying that the torsion coil spring 16 may take other configurations than the one shown in the drawings. For example, the spring 16 may not have two coil portions. It should be also noted that the terminal 16*d* of the torsion coil spring 16 and the terminals 17*a* of the leaf spring contacts 17 are connected to a power supply source, such as a battery, and an actuating or driving apparatus for a driver or passenger protecting apparatus such as air-bag (not shown) by way of lead wires (not shown). The collision detecting apparatus is positioned in a place where it can easily sense the deceleration caused by the collision. For example, the detecting apparatus may be mounted on a bumper in such disposition that the arrow X is directed in the moving direction of the motor vehicle with the shaft 13 positioned substantially horizontally.

Next, the principle of operation of the collision detecting apparatus described above will be explained by referring to FIG. 4. It is assumed that inertial moment of a rigid body or the disk assembly including the weight is represented by I, the distance between the center of shaft 13 constituting the rotation axis of the rigid body and the center of gravity is represented by $r$, the mass of the rigid body is by $m$ and the speed of the vehicle before the collision is represented by $V_o$. Then, the following formula can be obtained from the low of the angular momentum conservation;

$$mV_o \cdot r = I \cdot \omega_o \quad (1)$$

wherein $\omega_o$ is an initial angular velocity of the rigid body immediately after the collision. From the angular velocity $\omega_o$, the tangential velocity V, namely the speed in the moving direction of the motor vehicle can be given by the following formula.

$$V = \omega_o \cdot r \quad (2)$$

From the equations (1) and (2), $$V = (r^2/I) \cdot m \cdot Vo \quad (3)$$

When the weight of the rigid body is represented by $W$, $$W = m \cdot g$$

wherein $g$ is the gravitational acceleration.

Accordingly, the equation (3) can be rewritten as follows;

$$V = (r^2W)/(Ig) \cdot V_o$$

It is thus apparent that, when the parameters I, $r$ and W are so selected that $r^2 \cdot W/I \cdot g < 1$, the rotational velocity V of the rigid body at the center of gravity can be made smaller than the velocity $V_o$ of the vehicle before the collision. This means that the whole size of the detector apparatus can be reduced. In this connection, it is noted that, in the case of the system of particle V is equal to $V_o$ and therefore the miniaturization of the apparatus is impossible.

Next, a relationship between the characteristic vibration frequency of the system including the rigid body and the torsion coil spring and the variation in the sensing level of the detecting apparatus will be described to show that the collision detecting apparatus according to the invention exhibits better performances when the inherent vibration frequency lies in the range of 10 Hz to 30 Hz.

Figure 4:
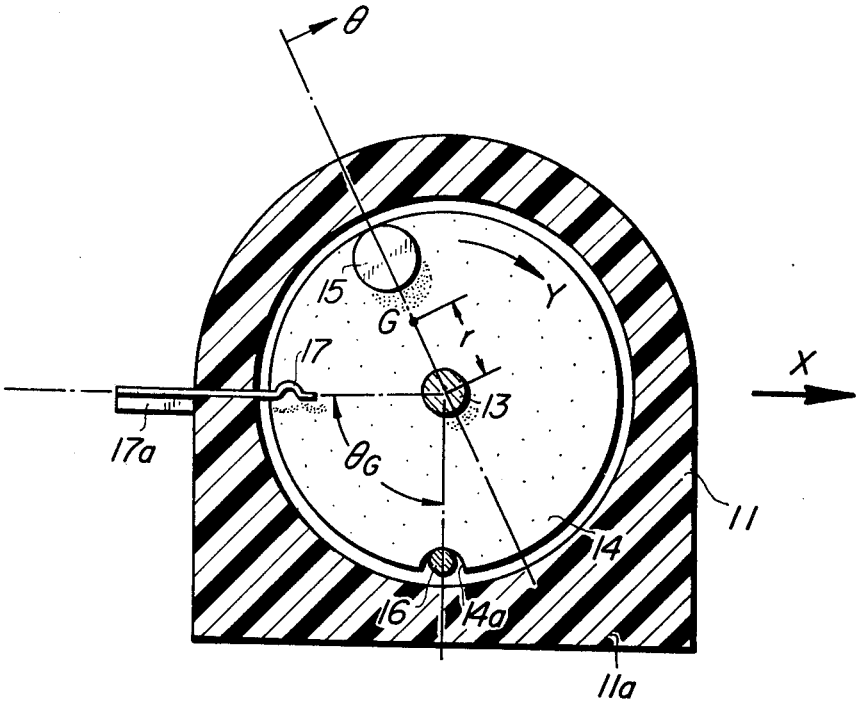
FIG. 4 is a partially enlarged view of FIG. 1 to illustrate the operation of the apparatus, FIG. 5 graphically shows a characteristic of deceleration to illustrate the operation of the apparatus shown in FIG. 1.
Figure 5:
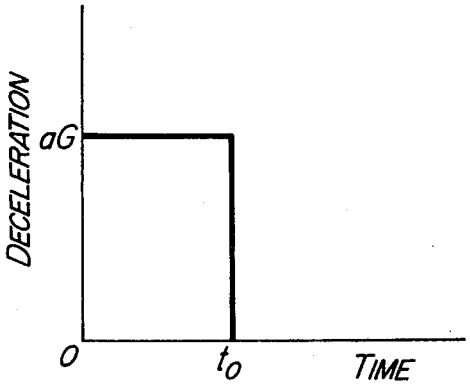

It is assumed that the deceleration upon the collision can be graphically represented in a rectangular form having an extremely short duration $t_o$, as is illustrated in FIG. 5. Then, the equation of motion of the rigid body at the center of gravity G which is put into the rotational movement under the influence of such deceleration can be given as follows;

$$I\,\theta = a\,G \cdot m \cdot r \cdot \cos\theta - K\,\theta \tag{4}$$

wherein the variable $\theta$ represents the rotational angle of the rigid body defined as illustrated in FIG. 4, $\theta$ is the quadratic differentiation of $\theta$; $a$G is deceleration such as shown in FIG. 5 and K is torsion rigidity of the torsion coil spring 16.

Assuming for the simplicity of description that the rotation angle $\theta$ produced during the time duration $t_o$ is so small that $\cos\theta \simeq 1$ may be valid, a solution of the equation (4) may be given by the following expression;

$$\ddot{\theta} = \frac{A \cdot aG}{f^2}(1 - \cos\omega_f t), \text{ when } 0 < t \leq t_o \tag{5a}$$

$$= \frac{A \cdot aG}{\omega_f 2}[\cos\omega_f(t - t_o) - \cos\omega_f t],$$

when $t \leq t_o$ (5b)

wherein $$\omega_f = \sqrt{\frac{k}{I}} \quad (\omega_f : \text{characteristic frequency}) \tag{6}$$

$$\text{and } A = (m\,.\,r)/(I) \tag{7}$$

Assuming again that a normally opened contact switch is closed when the rigid body has been rotated by an angular distance $\theta_G$ ($=\alpha$, as shown FIG. 1) which represents the maximum value of $\theta$ when $V = V_o$ and that $a$G $= V/t_o$, then $\theta_G$ for the generation of ideal pulse signal (or impulse) can be obtained by making $t_o$ approach to zero; namely $$\theta_G = \lim_{t_o \to o} 2\frac{A}{\omega_f 2} \cdot \frac{\sin\frac{\omega_f}{2} \cdot t_o}{t_o} \cdot V_o$$

$$= \frac{A}{\omega_f} V_o \tag{8}$$

When $\theta_G$ is selected to take the maximum value at the usual collision velocity $V = Vd$, $$\theta_G = \frac{A}{\omega_f} V_o = 2\frac{A}{\omega_f 2} \cdot \frac{\sin\frac{\omega_f}{2} \cdot t_o}{t_o} \cdot Vd \tag{9}$$

From the above equation (9), following formula can be derived. Namely, $$\frac{Vd}{V_o} = \frac{\omega_f}{2} \frac{t_o}{\sin\frac{\omega_f}{2} \cdot t_o} \tag{10}$$

In a similar manner, it follows from the formula (5$a$) that $$\frac{Vd}{V_o} = \frac{\omega_f \cdot t_o}{2} \tag{11}$$

From the expressions (10) and (11), it is obvious that the collision velocity Vd . which causes the rigid body to be rotated for the angle $\theta_G$ during the extremely short time span duration $t_o$, depends on the characteristic angular frequency represented by $\omega_f$.

It has been experimentally determined that, in the case of the collision of motor vehicles, the time duration $t_o$ is in the order of 12 m sec at maximum. When the variation of $V_o$ relative $t_o$ Vd is assumed to be about 20% and hence $Vd/V_o \leq 1.2$, then $$\omega_f \leq 0.2 \text{ m sec}^{-1}$$

and hence $$f \leq 30 \text{ Hz}$$

wherein $f = (\omega_f)/2a$ .

In this manner, the inventor(s) of the present application has found that the characteristic frequency of the rigid body as a system of plane motion should be selected no more than 30 Hz.

For determining the lower limit of the desired characteristic frequency, it is assumed that $t_o$ approaches to zero and $a$G = Vd/t, starting from the equation (5$b$). Then $$\theta(t) = \frac{A \cdot Vd}{\omega} \cdot \sin\left(t - \frac{t_o}{2}\right) \tag{12}$$

From the equation (8), $$\theta(t) = \theta_G = \frac{A}{\omega_f} \cdot V_o \tag{13}$$

From the above equations (12) and (13). $t$ can be obtained as follows;

$$t = \frac{1}{\omega_f} \cdot \sin^{-1}\left(\frac{V_o}{Vd}\right) + \frac{t_o}{2} \tag{14}$$

The above expression defines the time interval $t$ during which the collision detecting apparatus designed to be operative at the velocity $V_o$ is actuated by the collision velocity Vd. It is apparent that the time interval $t$ is increased, when the characteristic angular frequency $\omega_f$ is decreased. In other words, the characteristic frequency of an excessively small value will require a great actuation or responding time of the collision detector and will delay undesirably the generation of the collision signal. Usually, velocities in the order of 10 miles/hour (16 Km/hour) and 30 miles/hour (48 Km/hour) are selected for the velocities $V_o$ and Vd, respectively. When the actuation or response time $t$ is to be shorter than 10 m sec., then $$\omega > 0.07$$

and hence the characteristic frequency $f$ is given as follows;

$$f \leq 10 \text{ Hz}$$

This means that the lower limit of the characteristic frequency should be selected about 10 Hz.

It has now become apparent from the above discussion that the characteristic frequency $f$ of the system including the rigid body and the torsion spring should be selected in the range of 10 Hz to 30 Hz for the satisfactory operation of the collision detector apparatus.

The collision detector according to the invention operates in the following manner:

Since the disk 14 mounted on the shaft 13 supported rotatably through the bearings 12a and 12b is provided with the weight 15 adjacent to the periphery, the center of gravity of the disk assembly is shifted from the rotational axis of the shaft 13. Thus, when the disk assembly is subjected to deceleration upon the collision of the vehicle, the disk assembly will begin to rotate in the direction indicated by the arrow Y. At that time, the torsion coil spring 16 provides resistance to the rotation of the disk assembly. However, in the case of collision at a high velocity, the torque of the disk 14 will overcome the resistance of the spring 16 due to the fact that the characteristic frequency of the vibration system including the disk assembly and the spring 16 is selected in the range of 10 Hz to 30 Hz for the collision at such high speed. Since the straight portion **16*c* of the torsion coil spring 16 is engaged to the disk 14, the former is deformed to follow the rotation of the disk assembly, whereby the switch contacts constituted by the straight portion 16*c* and the leaf spring contacts 17 are caused to contact each other. As a result, the circuit between the terminals 16*d* and 17*a* is now established to produce a stabilized collision signal which serves to actuate an electric explosion means (not shown) for expanding the airbag. Experiments have shown that, for the generation of the collision signal in response to the detected acceleration or deceleration at the collision, the stationary position of the wieght 15 on the disk 14 should preferably be set such that the weight 14 forms an angle $\phi$ ($5° \leq \phi \leq 30°$) with the vertical line Z−Z, as is illustrated in FIG. 1.**

By setting the angle $\phi$ ($5° \leq \phi \leq 30°$), the detecting device is positively actuated with a deceleration larger than a predetermine value, even whether it is in a front collision or in a oblique angle collision of 30°, that is to say, the operation level of the device is stable. This facts is ascertaind by the experiments.

Because the element which abuts against the leaf spring contacts 17 constituting the stationary contact is formed by the straight portion 16c of the torsion coil spring 16, it is possible to obtain a stabilized signal accompanied with no chattering due to the elastic deformation of the straight portion 16c and the leaf spring 17. Furthermore, due to such arrangement that the center of gravity of the disk 14 is positioned between the rotation axis thereof and the weight 15, the diameter of the disk 14 can be made relatively smaller, which in turn allows the miniaturization of the apparatus for converting the collision energy into rotation energy.

When the vehicle is running on a rough road or when the vehicle is rapidly braked, the collision detecting apparatus may be caused to undergo some vibration. However, since the torsion spring 16 serves to restrictively confine the rotation of the disk 14 within a predetermined angle range for such vibration, the terminal **17*a* and 16*d*** will not be closed. In other words, the collision detecting apparatus according to the invention is insensitive to the vibration caused by the rapid braking or the like, whereby any erroneous operation which leads to the accidental explosion of the air-bag is inhibited.

Figure 6:
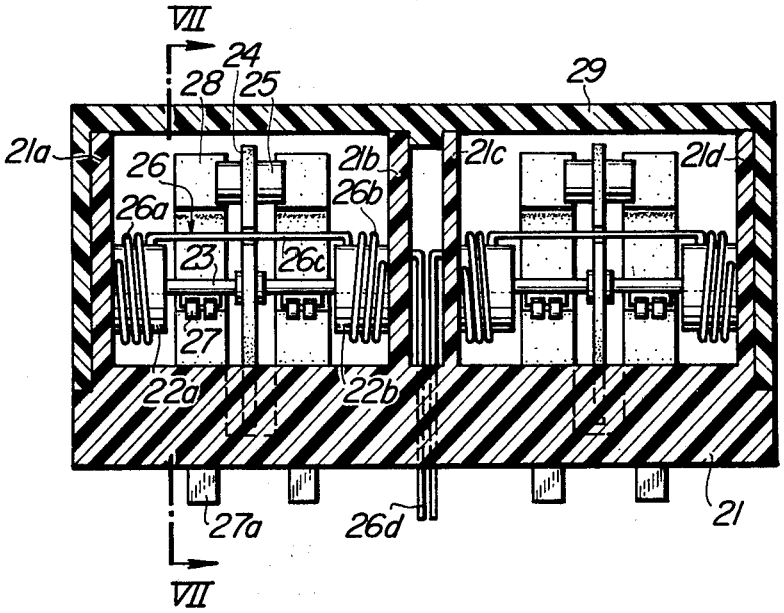
FIG. 6 is a cross-sectional view showing a second embodiment of the invention.
Figure 7:
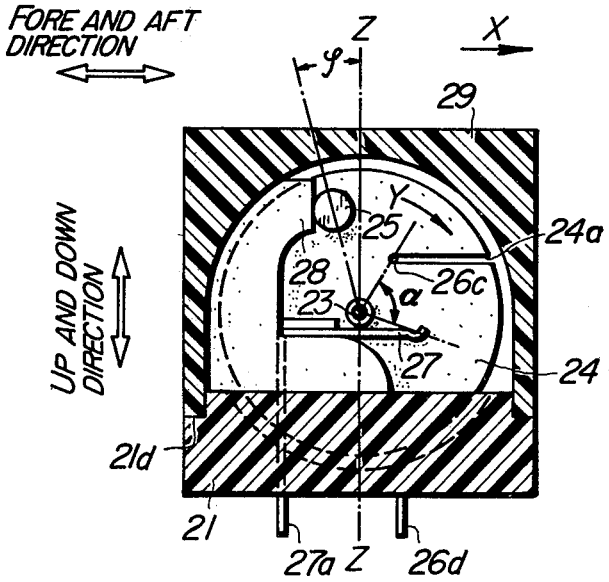
FIG. 7 shows a section of the same taken along the line III — III in FIG. 6, FIGS. 8 and 9 show respectively, modified embodiments of the invention.

FIGS. 6 and 7 show second embodiment of the invention in which two collision detecting assemblies according to the invention are arranged in a paired configuration in a single unit. The casing 21 is composed of four side plates **21*a*, . . . . , 21*d* and a thick bottom portion which are made of electric insulation material having a sufficient mechanical strength such as synthetic resin materials available under the trade name of "Delrin" or "Duracon", as is in the case of the first embodiment described hereinbefore in conjunction with FIGS. 1 to 3.**

Since the juxtaposed collision detector assemblies of the embodiment shown in FIG. 6 have the identical construction, description will be made only about the detecting assembly disposed at the left side as viewed in the drawing. Bearings **22*a* and 22*b*, shaft 23, disk 24, weight 25 and torsion coil spring 26** are fundamentally same as those of the first embodiment. Accordingly, any further description of these elements will be unnecessary.

The disk 24 is formed with an elongated linear notch **24*a* which receives the straight portion 26*c* of the torsion coil spring 26** at the innermost end.

Secured to the bottom of the casing 21 is an electrically conductive leaf spring 27 which is of L-like configuration and constitutes a fixed contact. To this end, the free end of the leaf spring 27 is formed with a semicircular concaved portion so as to easily contact with the straight portion **26*c* of the torsion coil spring 26. The leaf spring or fixed contact 27 is disposed at such position that it makes a predetermined angle with a line extending through the axis of the straight portion 26*c* of the torsion coil spring 26 and the central axis of the rotatable disk 24. It should be understood that a pair of such leaf springs are so arranged that each is disposed at every side of the disk 24. The other end of the leaf spring 27 extends outwardly through the casing 21 to form a terminal 27*a* at the outside of the casing 21. It will be appreciated that the straight portion 26*c* of the torsion coil spring 26 constitutes a movable contact, while the leaf springs 27** form the stationary contacts, whereby a normally open contact switch is accomplished.

Integrally formed with the casing 21 is a stopper 28 which is adapted to receive the weight 25 under the spring force of the torsion spring 26 to thereby prevent the rotation of the disk 24 in the direction opposite to the one indicated by the arrow Y. The stationary position of the weight 25 defined by the stopper 28 is so selected that the line connecting the centers of the weight and the shaft 25 forms an angle $\phi$ with a vertical line Z — Z passing through the center of the disk 24 in the direction opposite to the moving direction X of the vehicle. The value of angle $\phi$ should be in the range of 5° to 30°, although it depends on the set value of the deceleration to which the collision detector respond, and preferably set about 10° as is in the case of the first embodiment.

Reference numeral 29 indicates a cover which cooperates with the casing 21 to define a room for accommodating therein various components of the collision detector assemblies juxtaposed symmetrically to each other. The cover 29 is positioned by an offset portion 21d formed in the casing 21 and secured thereto. The cover 29 may be also made of a similar synthetic resin material as the casing 21. When the disks 24, torsion coil springs 26, leaf springs 27 and the stoppers 28 have been mounted in the casing 21, the cover 29 is then put into place on the casing 21 and sealed from the exterior. Test for examining the performance can be carried out through visual observation in the exposed state with removing the cover 29. After the examination, the cover 29 may be sealingly mounted on the casing 21.

Since the operation of the collision detector apparatus shown in FIGS. 6 and 7 is same as that of the first embodiment shown in FIGS. 1 to 3, description of the operation is omitted herein.

Figure 8:
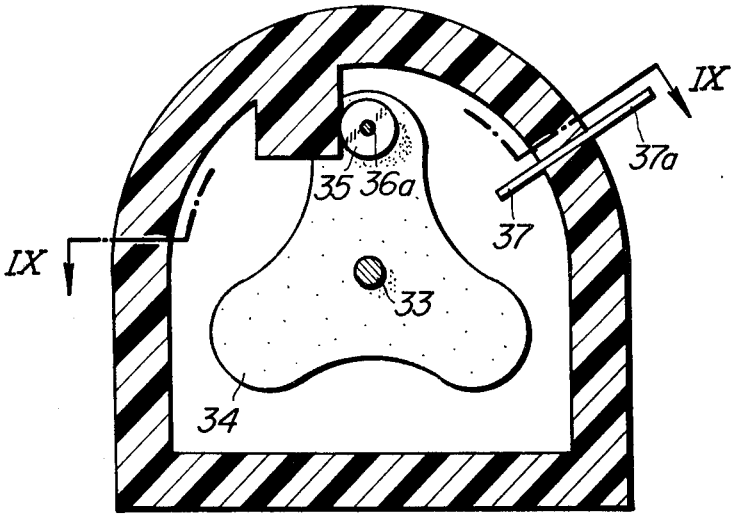
Figure 9:
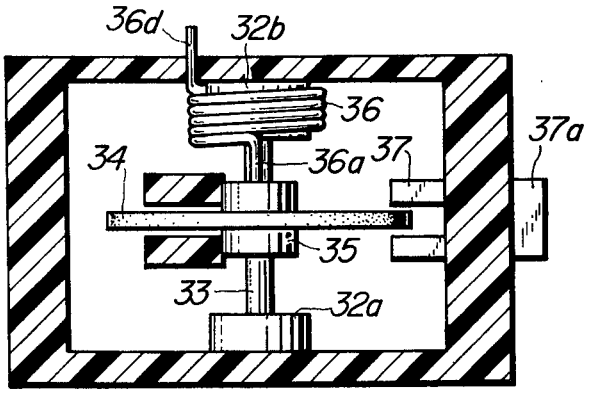

It is self-explanatory that the invention is never restricted to the embodiments described above. For example, a modification shown in FIGS. 8 and 9 is also possible without departing from the principle of the invention. In this modified embodiment, a "Y" figure like plate member 34 is employed in place of the disk 14 or 24, which plate 34 is provided with a weight 35 of an electrically conductive material. The plate 34 is mounted on a shaft 34 which is rotatably supported by means of bearings 32*a* and 32*b*. One end 36*a* of a torsion coil spring 36 is fixed to the weight 35, while the other end of the spring 36 is secured to the casing. The characteristic frequency of the vibrating system comprising the torsion coil spring 36 and the rigid body corresponding to the combination of the plate 34 and the weight 35 is of course selected at a value in the range of 10 Hz to 30 Hz also in this modified embodiment.

It is, however, to be noted that the movable contact constituted by the weight 35 and the torsion coil spring 36 cooperates with a stationary contact 37 to form the normally open switch. When the plate 34 is rotated upon the collision of the motor vehicle, the weight 35 will contact with the stationary contact 37 to establish the circuit between the terminals 36*d* and 37*a*, whereby a collision signal is generated.

Figure 10A:
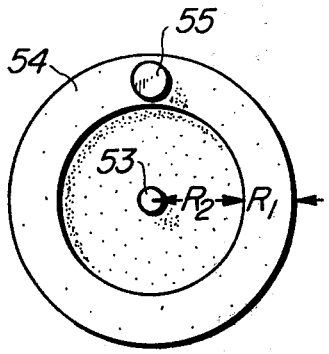
FIGS. 10*a* and 10*b* show a main portion of a modification of the invention in a side view and a sectional view, respectively.
Figure 10B:
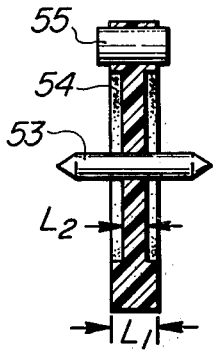

FIGS. 10*a* and 10*b* show a modification of the disk assembly of the embodiment shown in FIG. 2. As will be seen from these figures, the disk is formed with an outer massive peripheral portion which is thicker than the middle area of the disk 54, and is secured to a shaft 53 having tapered ends. With such arrangement, the weight of the disk 54 can be reduced so as to decrease the load applied to the bearings 12*a* and 12*b* as well as the shaft 53. The whole structure of the collision detecting apparatus may thus be miniaturized, since high mechanical strength is not required for the elements such as 12*a*, 12*b*, 53 and 54. A sufficient rotation moment is nevertheless assured due to the configuration of the disk 54 described above.

As a practical example of the structure shown in FIGS. 10*a*, 10*b*, when the ratio between the width $R_1$ of the massive peripheral portion and the width $R_2$ of the middle portion is selected to be 1 : 2, while the ratio between the thickness $L_1$ of the peripheral portion and that $L_2$ of the middle portion of the disk 54 at 2 : 1, the weight of the disk assembly can be reduced approximately 14 percent as compared with the disk assembly of an uniform thickness having the same diameter and inertial moment. In the above example, the dimensions $R_1$, $R_2$, $L_1$ and $L_2$ may be made equal to 4 mm, 8 mm, 4.2 mm and 2.1 mm, respectively.

Figure 11:
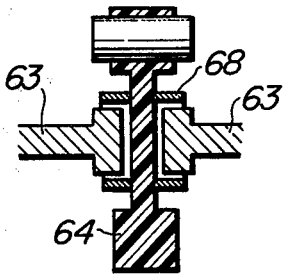
FIG. 11 is a sectional view showing a main portion of another modified embodiment.

In the case of the modified embodiment, the disk 54 is secured to the shaft 53 which in turn is rotatably supported by appropriate bearings (not shown). However, the supporting structure may be realized in such manner as shown in FIG. 11, in which the disk 64 similar to the disk 54 in FIG. 10*b* has bearings 68 at the opposite sides and adapted to be rotatably supported between projecting shafts 63 secured to the casing (not shown).

Figure 12A:
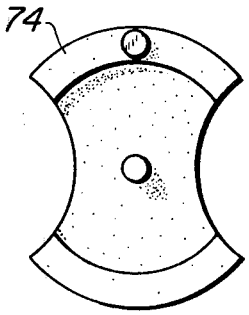
FIG. 12*a* and FIG. 12*b* show a main portion of still another modification of the invention in a side view and a sectional view, respectively.
Figure 12B:
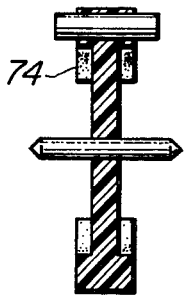

Furthermore, the rotable disk may be constructed in such a form shown in FIGS. 12*a* and 12*b*. In this case, the disk 74 is circularly recessed at the opposite peripheral portions. Such configuration of the disk 74 will reduce the load applied to the shaft and the supporting bearings and enhance the reliability of operation. Besides, the whole structure of the apparatus may be further miniaturized to facilitate the installation thereof even in a narrow space of the motor vehicle.

Figure 13:
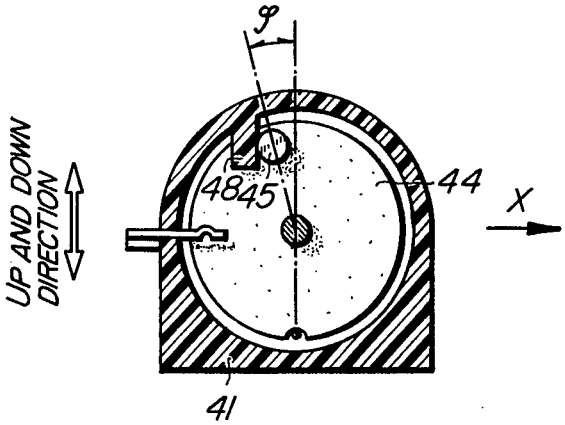
FIG. 13 is a cross-sectional view of a further modification of the invention.

Additionally, the stopper may be employed even in the first embodiment in a form shown in FIG. 13, in which the stopper 48 is formed in the casing 41 to receive the weight 45, thereby to prevent the rotation of the disk 44 in the reverse direction.

What is claimed is:

1. Apparatus for detecting the collision of a motor vehicle, comprising:

a casing;

a shaft supported by said casing;

a disk-like rotational member supported, at the center thereof, by said shaft;

bearing means mounted on at least one of said casing and said shaft for rotatably supporting said rotational member;

a column-like weight member which is mounted on said rotational member so as to shift from the center axis of said shaft the center of mass of the rotational member including said column-like weight member, thereby said rotational member is rotated under acceleration or deceleration;

a spring member resiliently engaging between said casing and said rotational member so as to normally maintain said rotational member in a stationary condition and to prevent said rotational member from rotating beyond a predetermined angle when acceleration or deceleration lower than a predetermined level is exerted thereto, said spring member being electrically conductive and having at least one end portion projected from said casing for connection to an electrical circuit;

a movable contact member which is fitted to said rotational member for rotation with said rotational member, and is electrically connected to said spring member;

a stationary resilient contact member secured to said casing for contacting said movable contact when the latter is rotated beyond a predetermined angle, whereby a circuit path generating an electrical collision signal is established.

2. Apparatus as set forth in claim 1, wherein said shaft is supported substantially horizontally, and said rotational member is secured to said shaft substantially at a right angle to the center axis of said shaft.

3. Apparatus as set forth in claim 2, wherein said weight member is mounted on said rotational member in such a manner that the stationary position of said weight is an angular position in the range 5° to 30° from a vertical line passing through said center axis of said shaft.

4. Apparatus as set forth in claim 1, wherein the circular peripheral portion of said rotational member is thicker than the inner portion thereof, and said weight member is mounted on said peripheral portion.

5. Apparatus as set forth in claim 1, wherein said weight member is made of an electrically conductive material and comprises said movable contact member.

6. Apparatus as set forth in claim 5, wherein said stationary contact is comprised of a leaf spring.

7. Apparatus as set forth in claim 6, wherein said leaf spring has a curved and contoured portion for receiving said movable contact at said contoured portion.

8. Apparatus as set forth in claim 6, wherein a plurality of bifurcated members are provided to said leaf spring at portions where said movable contact is brought into contact, said bifurcated members being spaced along the axis of said shaft at both sides of the rotational member.

9. Apparatus as set forth in claim 5, wherein said spring member consists of a spiral torsional spring having coil portions at both ends thereof and a straight portion connecting said coil portions.

10. Apparatus as set forth in claim 1, wherein said bearing means are mounted on said casing, and said spring member comprises coil portions and a straight portion, one coil portion being disposed around the outer surface of each said bearing means, while said straight portion engages said rotational member, and comprises said movable contact member.

11. A collision detecting apparatus for a motor vehicle comprising:

a nonconductive casing;

bearings fixed in said casing;

a shaft rotatably supported by said bearings at both end portions thereof;

a disk plate fixed perpendicularly to said shaft substantially at the center thereof;

a column weight arranged in one peripheral portion of said disk plate as to project an end thereof from both sides of the disk plate, thereby shifting from the center of said disk plate the center of mass of said disk plate including said column weight;

a conductive coiled spring disposed in said casing and having coiled portions and straight portion between said coiled portions, one end portion of said each coiled portion being fixed to said casing and said straight portion cooperating with said disk plate so as to resist the rotation of said disk plate; and a conductive leaf spring fixed to said casing at a portion opposite to said straight portion of said conductive coiled spring and having at least two resilient portions spaced at both sides of the disk plate along the axis of the shaft, said resilient portion elastically receiving said straight portion of said conductive coiled spring so that the contact between said conductive leaf spring and said conductive coiled spring is positively attained to stably establish a circuit path generating a collision signal when said disk plate rotates at an angle more than a predetermined angle in response to vehicle acceleration or deceleration.

* * * * *